US008447533B1

(12) United States Patent
Sinclair et al.

(10) Patent No.: US 8,447,533 B1
(45) Date of Patent: May 21, 2013

(54) METHOD OF WASTEWATER FLOW MEASUREMENT, SYSTEM ANALYSIS, AND IMPROVEMENT

(75) Inventors: Franklin Sinclair, New Orleans, LA (US); David D. Williams, Claremore, OK (US)

(73) Assignee: Eastech Flow Controls, Inc., Tulsa, OK (US)

( * ) Notice: Subject to any disclaimer, the term of this patent is extended or adjusted under 35 U.S.C. 154(b) by 258 days.

(21) Appl. No.: 12/902,218

(22) Filed: Oct. 12, 2010

Related U.S. Application Data

(60) Provisional application No. 61/251,004, filed on Oct. 13, 2009.

(51) Int. Cl.
*G01F 1/00* (2006.01)
*G01F 7/00* (2006.01)
*G01F 23/00* (2006.01)

(52) U.S. Cl.
USPC ..... 702/45; 702/55; 702/156; 702/166

(58) Field of Classification Search
USPC ..... 702/45, 55, 156, 166
See application file for complete search history.

(56) References Cited

U.S. PATENT DOCUMENTS

| | | | |
|---|---|---|---|
| 4,034,607 | A | 7/1977 | Martig, Jr. |
| 4,202,211 | A | 5/1980 | Perry |
| 4,367,652 | A | 1/1983 | Venuso |
| 4,571,997 | A | 2/1986 | Kepple et al. |
| 4,987,913 | A | 1/1991 | Kodate et al. |
| 5,091,863 | A | 2/1992 | Hungerford et al. |
| 5,342,144 | A | 8/1994 | McCarthy |
| 5,423,226 | A | 6/1995 | Hunter et al. |
| 5,506,791 | A | 4/1996 | Hungerford et al. |
| 5,587,926 | A | 12/1996 | Chiu et al. |
| 5,691,914 | A | 11/1997 | Randolph |
| 5,835,386 | A | 11/1998 | Orr et al. |
| 5,852,240 | A | 12/1998 | LeBlanc |
| 6,196,762 | B1 | 3/2001 | Stude |
| 6,208,943 | B1 | 3/2001 | Randolph et al. |
| 6,346,193 | B1 | 2/2002 | Bauer |
| D457,491 | S | 5/2002 | Kaiser et al. |
| 6,412,550 | B1 | 7/2002 | McLaughlin |
| 6,427,532 | B1 | 8/2002 | Keller |
| 7,428,462 | B1 | 9/2008 | Swift |

(Continued)

OTHER PUBLICATIONS

"Hydraulic Radius Design Equations Formulas Calculator", 2002, Publisher: Printout from Internet on Sep. 30, 2010, Published in: US.

*Primary Examiner* — Janet Suglo
(74) *Attorney, Agent, or Firm* — Brown Patent Law, P.L.L.C.; Dennis D. Brown

(57) ABSTRACT

A method of reducing rainwater and/or groundwater inflow and infiltration into a wastewater treatment collection grid. The method preferably involves the steps of (a) dividing the grid into a plurality of major subsystems, (b) determining flow depth levels in each major subsystem under dry and wet conditions, (c) using these wet weather and dry weather flow depth measurements to determine a volume flow ratio for wet versus dry conditions, (d) using these flow ratios to identify the particular major subsystem(s) in which the greatest amount of inflow or infiltration is occurring, and then (e) further dividing the highest ranking major subsystem(s) into smaller subsystems in which the same dry and wet weather level measurement and ranking analysis is preferably conducted to further isolate problem locations for surveillance, maintenance, and/or repair.

18 Claims, 4 Drawing Sheets

U.S. PATENT DOCUMENTS

| | | | | |
|---|---|---|---|---|
| 7,469,598 | B2 | 12/2008 | Shkarlet et al. | |
| 7,721,600 | B1 | 5/2010 | Sinclair et al. | |
| 2003/0015317 | A1 | 1/2003 | McLaughlin | |
| 2004/0076473 | A1 | 4/2004 | Burkhart | |
| 2005/0177323 | A1* | 8/2005 | Saylor | 702/45 |
| 2006/0122794 | A1 | 6/2006 | Sprague et al. | |

* cited by examiner

METHOD OF WASTEWATER FLOW MEASUREMENT, SYSTEM ANALYSIS, AND IMPROVEMENT

This application claims the benefit of U.S. Provisional Patent Application Ser. No. 61/251,004, filed on Oct. 13, 2009, the disclosure of which is incorporated herein by reference as if fully set out at this point.

FIELD OF THE INVENTION

The present invention relates to methods of wastewater flow measurement, system analysis, and improvement.

BACKGROUND OF THE INVENTION

From 2004 to 2009, the average U.S. national wastewater treatment rate increased by 28%. There are approximately 18,500 municipalities in the United States producing 40 billion gallons of wastewater per day at a taxpayer cost of $150,000,000 or $55 billion dollars annually. A study by the Association of Metropolitan Sewage Agencies indicates that 25% of this 40 billion gallons per day, or $14 billion annually, is due to inflow and infiltration of ground and storm water, the cause of which is directly linked to an aging and faulty sewer infrastructure.

For calculation of flow in an open channel that is gravity fed, a well established method is used. This method, known as the Mannings equation, allows a flow value to be derived by first knowing certain conditional parameters of the application. One of the parameters is the roughness of the channel material usually obtained by an empirically derived table of constants. Another parameter is the slope of the channel specified in percentage of horizontal length to vertical drop. These parameters may be difficult to obtain with any certainty or may require stopping flow, which may not be practical for meter site installation.

The base Circular Mannings equation is in the form of:

$$Q = \frac{1.49 * A * R^{2/3} * S^{1/2}}{n}$$

Where A is the area of flow, R is the hydraulic radius, S is the slope of the pipe and n is the roughness coefficient of the pipe. Unfortunately, heretofore during meter installation, it has typically been required to go into a confined space area to get measurements required for accurate flow calculation. This created a potential safety risk and required special equipment and permits.

SUMMARY OF THE INVENTION

We have developed and invented a breakthrough technology that now makes it economically feasible for every municipality in the country to cost effectively reduce its wastewater treatment charges. In one aspect, the invention provides an advanced mapping technology which provides the ability to determine volumetric differences in wastewater flows between dry and wet days, except without the requirement for ascertaining pipe slopes and coefficients of roughness.

The inventive method paves the way for municipalities to begin the process of realizing substantial decreases in their wastewater treatment charges at a fraction of the cost of conventional methods. One major economic advantage of the invention lies in its ability to detect and locate at a minimal cost millions of additional gallons of ground and storm water that enter the collection system due to inflow and infiltration. This unique ability for locating inflow and infiltration identifies and facilitates improvements and repairs for reducing a municipality's treatment costs by hundreds of thousands of dollars.

We have discovered that volumetric differences in wastewater flows between periods of dry and wet weather can be determined and that those differences are identical to the ones calculated by the globally accepted Manning's Equation, except without the requirement for confined space entry in order to ascertain pipe slopes and coefficients of roughness. Thus, an entirely new methodology for reducing wastewater treatment costs has been developed.

In one aspect, there is provided a method of reducing rainwater and/or ground water inflow and/or infiltration into a wastewater collection grid having collection pipes or other channels. The method preferably comprises the steps of: (a) dividing the wastewater collection grid into a plurality of major subsystems; (b) determining for each of the major subsystems a dry weather piping flow depth level (Dd) for flow during dry weather conditions; (c) determining for each of the major subsystems a wet weather flow depth level (Dw) for flow during wet weather conditions or during a combination of wet weather and dry weather condition; (d) determining for each of the major subsystems, based upon the dry weather flow depth (Dd), a dry weather cross-sectional area of flow (Ad); (e) determining for each of the major subsystems, based upon the wet weather flow depth (Dw), a wet weather cross-sectional area of flow ($A_w$); (f) determining for each of the major subsystems a ratio ($\Delta Q$) of wet weather volume flow rate to dry weather volume flow rate according to the formula:

$$\Delta Q = \frac{Aw}{Ad} * \left(\frac{Rw}{Rd}\right)^{2/3}$$

wherein Rw is a wet weather hydraulic flow radius based upon Aw, and Rd is a dry weather hydraulic flow radius based upon Ad; and (g) using the $\Delta Q$ ratios for the major subsystems to at least identify which one of the major subsystems ranks highest in contributing to the wastewater collection grid a greater volume amount and/or cost amount of the rainwater and/or ground water.

In the inventive method just described, step (g) preferably involves using the $\Delta Q$ ratios for the major subsystems to identify a subset of highest ranking major subsystems. The highest ranking major subsystems falling within this subset are preferably those which (1) rank highest in contributing to the wastewater collection grid greater volume amounts and/or cost amounts of the rainwater and/or ground water and (2) together account for from about 50% to about 80% of a total volume amount and/or cost amount of the rainwater and/or groundwater received by the wastewater collection grid.

It is also preferred that, for each of the major subsystems, the dry weather flow depth level (Dd) and the wet weather flow depth level (Dw) be determined in steps (b) and (c) using a flow depth level detector installed via a manhole at a base outlet end of the major subsystem. Further, it is preferred that step (g) of the method described above include the steps of: (i) determining from survey data an estimated number of residents served by each of the major subsystems; (ii) determining for each of the major subsystems an estimated dry weather wastewater volume flow rate (Qd) based upon the estimated number of residents served by the major subsystem; and (iii) determining for each of the major subsystems a wet weather volume flow rate (Qw) by multiplying the estimated dry weather wastewater flow rate (Qd) for the major subsystem by the ΔQ ratio determined for the major subsystem in step (f).

It is also preferred that step (g) further comprise the step of determining for each of the major subsystems a volume amount of rainwater and/or ground water contributed by the major subsystem to the wastewater collection grid by subtracting the estimated dry weather wastewater volume flow rate (Qd) for the major subsystem from the wet weather flow rate (Qw) for the major subsystem.

In addition to steps (a) through (g) described above, it is also preferred that the above-described method of reducing rainwater and/or ground water inflow and/or infiltration into a wastewater piping grid further comprise the steps of: (h) dividing the highest ranking major subsystem, or dividing each major subsystem included in a subset of highest ranking major subsystems, into a plurality of smaller subsystems; (i) determining for each of the smaller subsystems a dry weather flow depth level (SDd) for flow during dry weather conditions; (j) determining for each of the smaller subsystems a wet weather flow depth level (SDw) for flow during wet weather conditions or during a combination of wet weather and dry weather conditions; (k) determining for each of the smaller subsystems, based upon the dry weather flow depth (SDd), a dry weather cross-sectional area of flow (SAd); (1) determining for each of the smaller subsystems, based upon the wet weather flow depth (SDw), a wet weather cross-sectional area of flow (SAw); (m) determining for each of the smaller subsystems a ratio (ΔSQ) of wet weather volume flow rate to dry weather volume flow rate according to the formula:

$$\Delta SQ = \frac{SAw}{SAd} * \left(\frac{SRw}{SRd}\right)^{2/3}$$

wherein SRw is a wet weather hydraulic flow radius based upon SAw, and SRd is a dry weather hydraulic flow radius based upon SAd; and (n) using the ΔSQ ratios for the smaller subsystems to at least identify which smaller subsystem in each of the one or more major subsystems in question ranks highest in contributing a greater volume amount and/or cost amount of rain and/or ground water.

Further, the method preferably comprises the step of (o) conducting camera surveillance within the one or more smaller subsystems identified in step (n) to discover locations of inflow and/or infiltration of rainwater and/or groundwater.

More preferably, step (n) described above will be conducted such that the ΔSQ ratios are used to identify within each of the one or more highest ranking major systems a subset of smaller subsystems which (i) rank highest in contributing a greater volume amount and/or cost amount of rainwater and/or groundwater to the major subsystem and (ii) together account for from about 50% to about 80% of a total volume amount and/or cost amount of rainwater and/or groundwater received by the major subsystem.

In order to determine the dry weather flow vertical depth level (SDd) and the wet weather flow vertical depth level (SDw) for any given smaller subsystem identified in the inventive method, a depth level detector will preferably be installed via a manhole at an outlet end of the smaller subsystem. In the same manner as described above for the major subsystems, it is also preferred that the estimated dry weather wastewater volume flow rates and wet weather volume flow rates for any given smaller subsystem be determined based upon (1) the ΔSQ ratio for the smaller subsystem in question and (2) an estimated dry weather wastewater volume flow rate for the smaller subsystem derived from survey data providing an estimated number of residents served by the smaller subsystem.

Further aspects, features, and advantages of the present invention will be readily apparent to those of ordinary skill in the art upon examining the accompanying drawings and upon reading the following detailed description of the preferred embodiments.

DETAILED DESCRIPTION OF THE PREFERRED EMBODIMENTS

The inventive method provides municipalities with a clear picture of exactly what is transpiring within their wastewater infrastructure grids. The inventive method can:

- Locate and report areas of inflow and infiltration by volume.
- Break down costs associated with inflow and infiltration.
- Locate and report illegal sump pump and roof drain connections.
- Provide data for infrastructure cost/benefit studies.
- Locate and report areas of highest inflow and infiltration for efficient use of camera surveillance.
- Identify and report pipe capacity and maintenance issues.

Figure 1A:
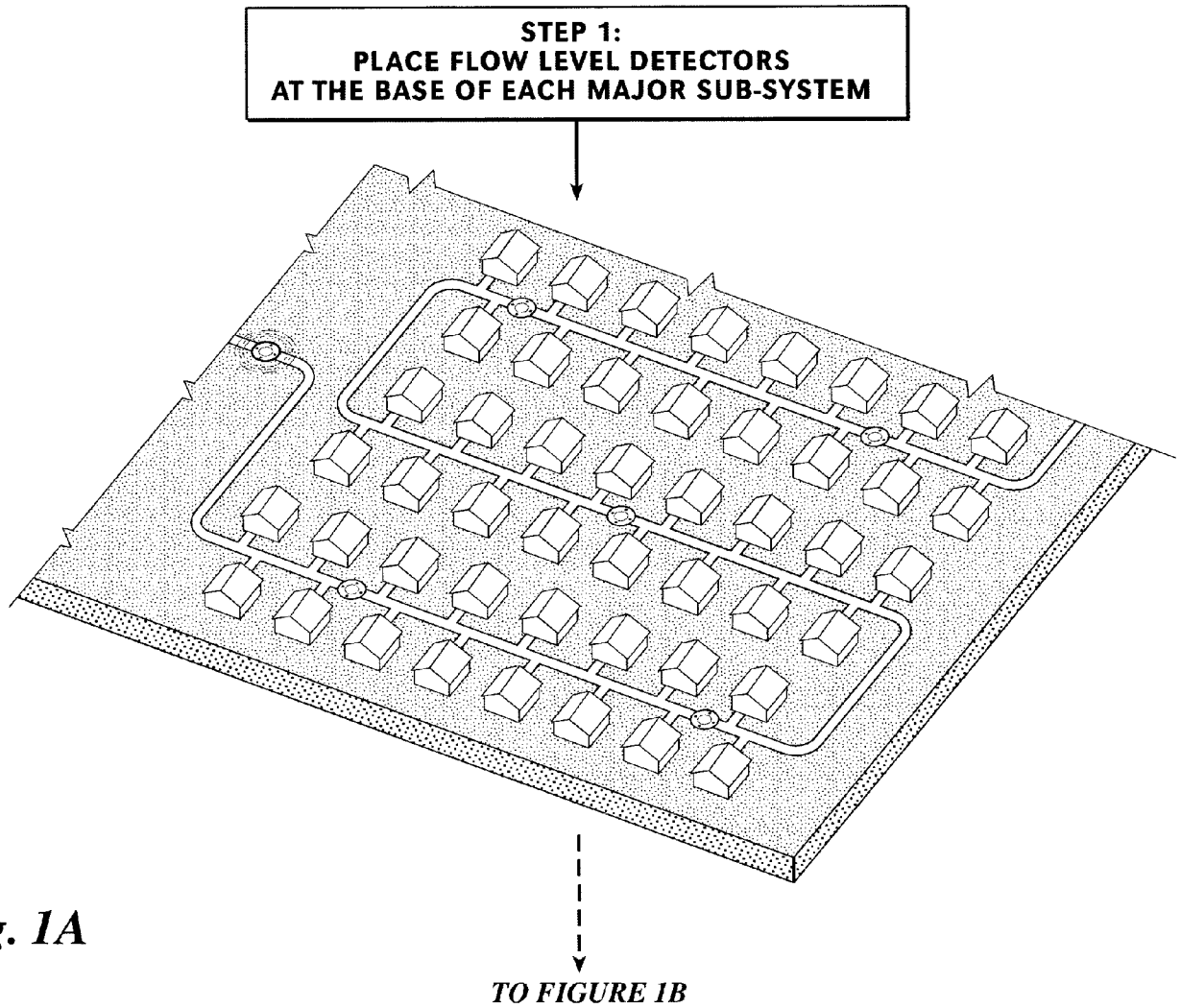
FIGS. 1A and 1B schematically illustrate an embodiment of the inventive method involving a survey and analysis of major sub systems within a collection grid followed by a more detailed manhole survey and analysis of the particular subsystems ranking highest for inflow and infiltration.
Figure 1B:
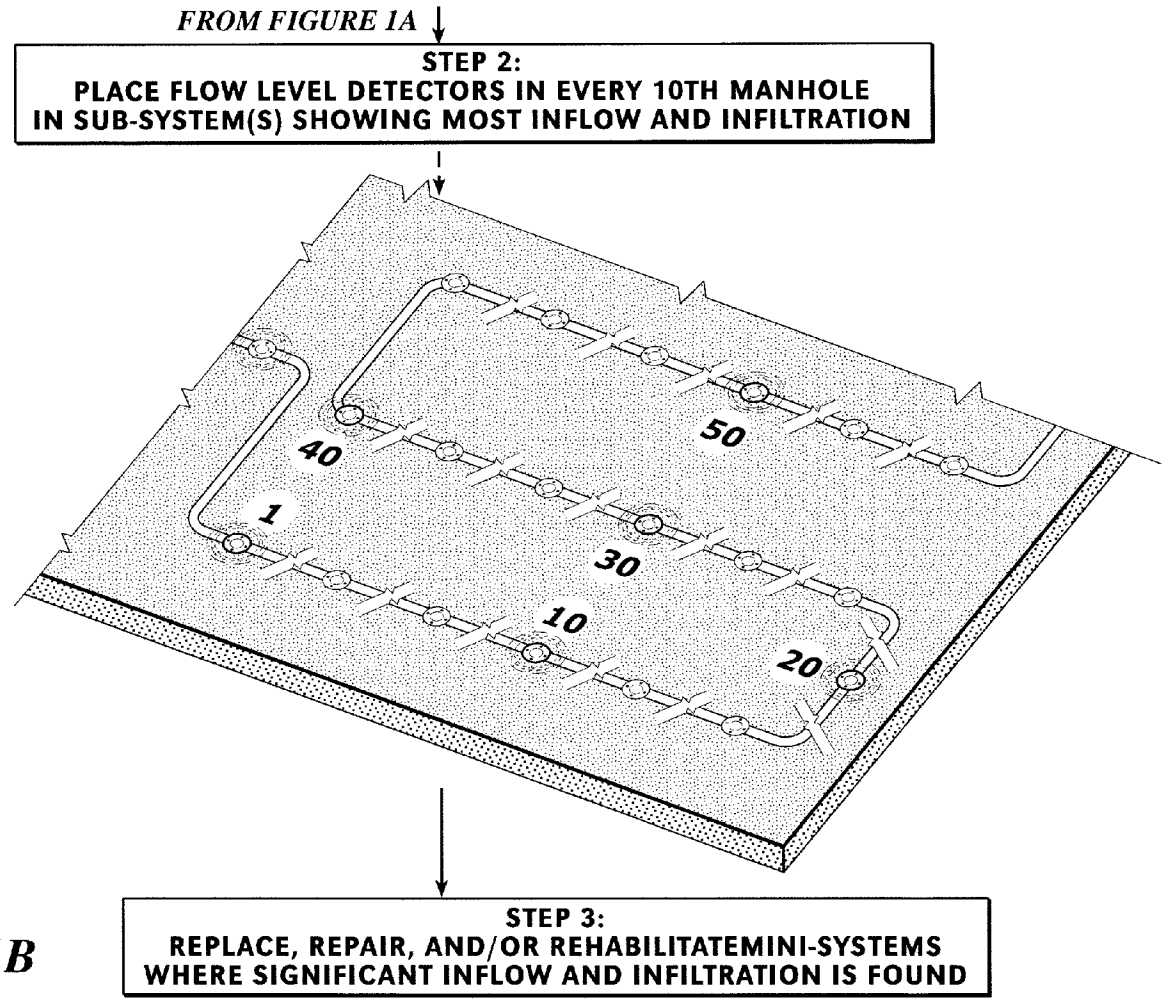

In accordance with the suggestions of both the EPA and American Water Works Association, the inventive method also preferably uses a "systems approach" for locating major sources of inflow and infiltration. As illustrated in FIG. 1, wastewater collection systems selected for investigation are initially divided into separate major subsystems (major basins) and then again into smaller subsystems (mini-systems) in order to cost effectively ascertain the most prevalent areas of unwanted ingress.

Inflow and infiltration detection monitors are preferably strategically placed within designated manholes of each subsystem (major basin) comprising the overall collection system. An onboard data logger preferably records the differences in wastewater depth levels between specified periods of (a) dry weather and (b) combined dry and wet weather. An internal flash card or other medium within each detection monitor preferably stores the pertinent information for easy transfer to a personal computer or other system having analysis software stored thereon. The software program preferably initiates both a volumetric and cost analysis report of the effects of any extraneous flows that have entered the subsystem during the designated monitoring period. Once the subsystems contributing the highest rate of inflow and infiltration are revealed, the detection monitors are preferably removed and repositioned (again without the need for confined space entry) in order to detect and locate those segments within each subsystem contributing the majority of unwanted ground and storm water.

Extensive international studies of inflow and infiltration have proven in case after case that the 80/20 principle usually applies (approximately 20% of the wastewater infrastructure network contributes 80% of the inflow and infiltration). These extensive studies only confirm the economic value of implementing our structured performance mapping approach. Using the inventive method, municipal managers can pinpoint the probable 20% of the collection grid contributing the major portions of inflow and infiltration.

Initially, a portable detection monitor is preferably placed at the base of each major subsystem within the overall collection grid. The detection monitor monitors and records flow level depth preferably for a period of days (most preferably at least five consecutive days) in order to establish a "dry weather" baseline for calculating a pattern of diurnal flows completely absent of inflow and infiltration. The identical procedure is then repeated preferably for a period of weeks (most preferably at least three consecutive months) of combined dry and wet weather. Once the collected data is gathered and transferred, i.e., using flash card technology, other media, or by electronic, radio or other data transmission, to the analysis program, the volume and cost of the extent of inflow and infiltration affecting each major subsystem is determined and categorized.

In contrast to prior techniques, the inventive method is preferably based on the determination and analysis of flow ratios derived in accordance with the formula:

$$\Delta Q = \frac{Qw}{Qd} = \frac{Aw}{Ad} * \left(\frac{Rw}{Rd}\right)^{2/3}$$

wherein: ΔQ is a ratio of wet weather volume flow rate to dry weather volume flow rate; Qw is the wet weather flow rate; Qd is the dry weather volume flow rate; Aw is the wet weather flow area (i.e., cross-sectional area of the flow in the pipe or channel); Ad is the dry weather flow area; Rw is the wet weather flow hydraulic radius; and Rd is the dry weather flow hydraulic radius.

Using this approach allows the ratio wet to dry volume flow rates (ΔQ) to be calculated without actually knowing the absolute flow rate in either of the dry or wet cases. This allows a flow ratio metric value to be obtained without the need to measure the slope variable or the need to input the channel material roughness. The flow ratio can be implemented in the inventive water cost analysis program allowing improvements in proper water treatment by showing increases in flow rates during environmental events such as rainfall or improper infiltration. Additional benefits are eliminating the need for slope or roughness measurement during installation. The inventive method also allows an accurate comparative analysis to be performed at several sites without the need of a confined space entry.

Figure 2:
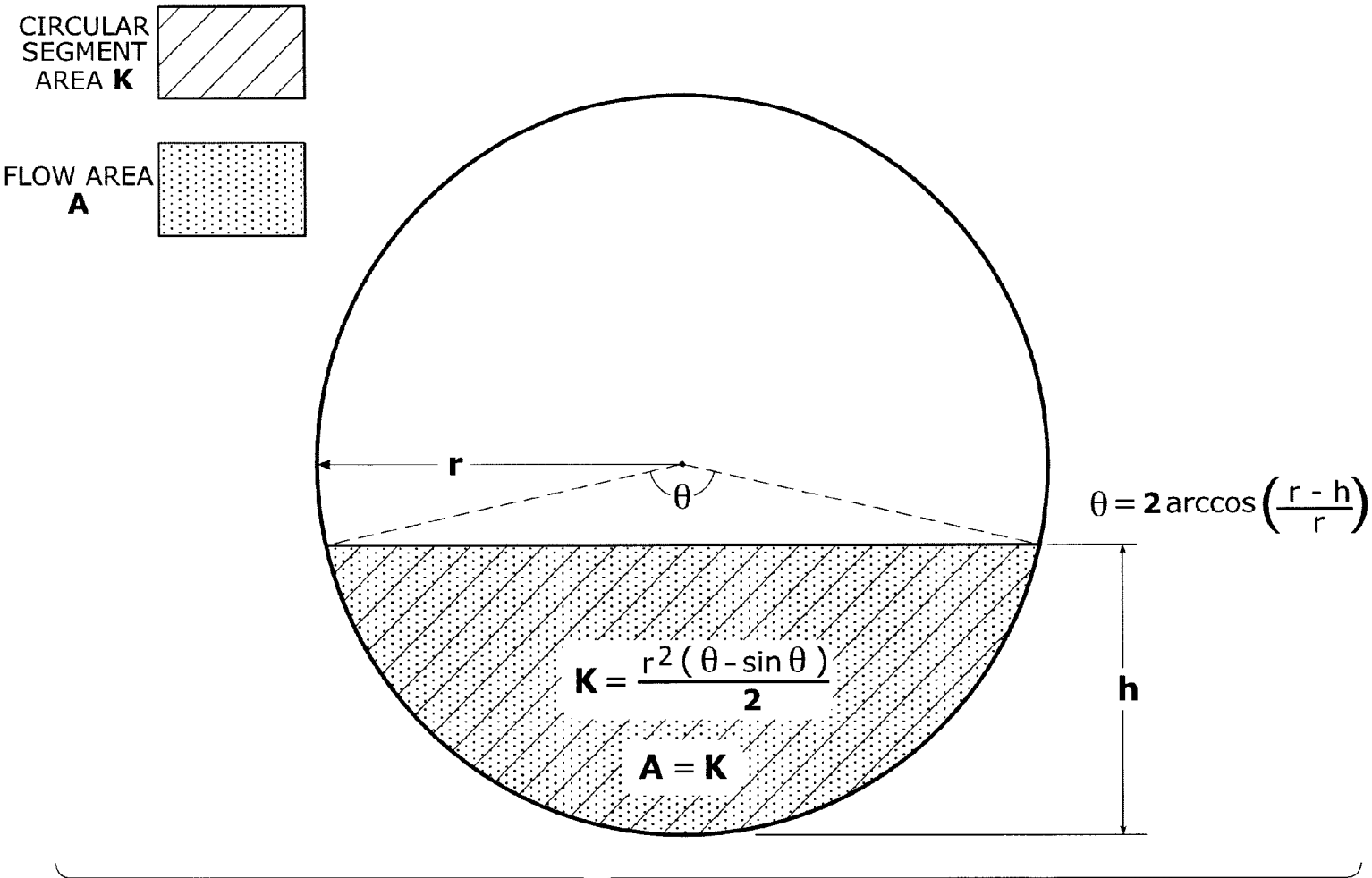
FIG. 2 is a cross-sectional view of a horizontal or near horizontal wastewater grid pipe showing known geometric and flow parameters wherein wastewater is flowing through the pipe at a depth level which is less than the interior radius (r) of the pipe (i.e., the depth of flow is at a level such that the pipe is less than half full).
Figure 3:
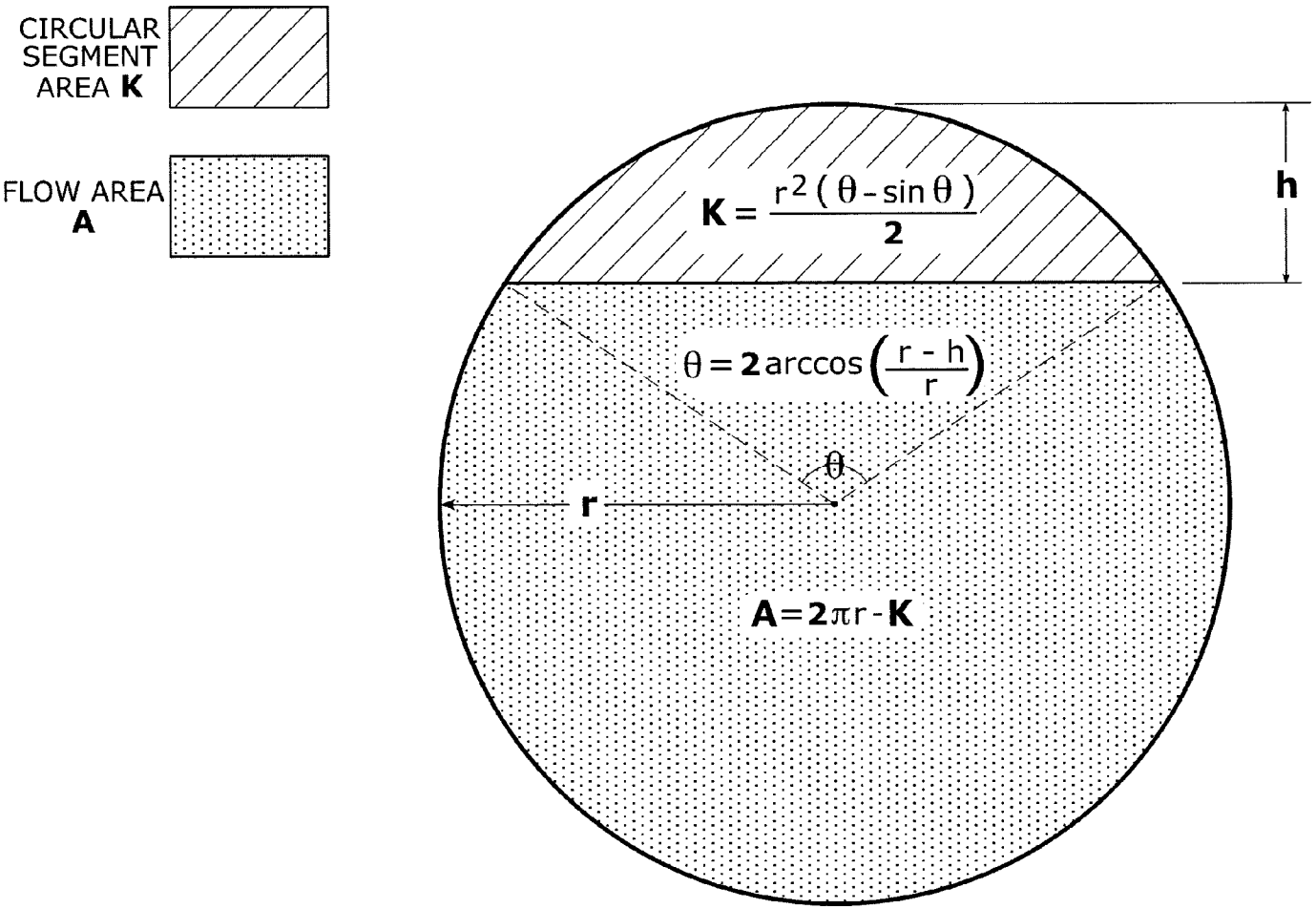
FIG. 3 is a cross-sectional view of a horizontal or near horizontal wastewater grid pipe showing known geometric and flow parameters wherein wastewater is flowing through the pipe at a depth level which is more than the interior radius (r) of the pipe (i.e., the depth of flow is at a level such that the pipe is more than half full).

As is readily understood, once the vertical depth level (d) of wastewater flowing through a horizontal or near horizontal pipe has been determined, the flow area Aw or Ad and the corresponding hydraulic flow radius Rw or Rd can be readily determined using well known geometric and flow parameters and formulas. In the case of a pipe having an interior radius (r) wherein wastewater is flowing at a depth of less than half full as illustrated in FIG. 2, the relevant flow parameters as depicted in FIG. 2 are determined in accordance with the following well known formulas:

circular segment height $h$=flow depth $d$ central angle $\theta=2 \arccos [(r-h)/r]$ circular segment area $K=r^2(\theta-\sin\theta)/2$ arc length $s=r\times\theta$ flow area $A=K$ wetted perimeter $P_w=S$ hydraulic Radius $R_h=A/P_w$ If, in the other hand, the pipe is more than half full as illustrated in FIG. 3, the relevant formulas are:

Circular segment height $h=2r-d$

Central angle $\theta=2 \arccos [(r-h)/r]$

Circular segment area $K=r^2(\theta-\sin\theta)/2$

Arc length $s=r\times\theta$

Flow area $A=\pi r^2-K$

Wetted perimeter $Pw=2\pi r-s$

Hydraulic radius $R_h=A/P_w$

EXAMPLE I

TABLE 1

Report 1
Inflow and Infiltration (I&I) Contribution Analysis

| DELTA Q CALCULATION | | SUBSYSTEM 1-8 | | (APR. 1-JUN. 30) | |
|---|---|---|---|---|---|
| Sub-system | Sewer Length (Ft.) | Pipe Diameter (In.) | Av. Dry Day level (% Full Pipe) | Avg. Dry + Wet Day Level (% Full Pipe) | Δ Q Avg. Change in Volume Due to I&I |
| 1 | 20,000 | 12 | 25% | 33% | 1.67 |
| 2 | 19,000 | 10 | 25% | 31% | 1.52 |
| 3 | 22,000 | 8 | 25% | 27% | 1.21 |
| 4 | 21,000 | 12 | 25% | 27% | 1.14 |
| 5 | 20,000 | 15 | 27% | 29% | 1.15 |
| 6 | 24,000 | 18 | 28% | 30% | 1.16 |
| 7 | 18,000 | 10 | 30% | 43% | 1.95 |
| 8 | 20,000 | 8 | 25% | 26% | 1.10 |

As can be ascertained from Report 1, 50% of the total inflow and infiltration is contributed by subsystems 1 and 7.

TABLE 2

Report 2
Inflow and Infiltration (I&I) Contribution Analysis

| VOLUME & COST CALCULATION | | SUBSYSTEM 1-8 | | (APR. 1-JUN. 30) | |
|---|---|---|---|---|---|
| Sub-system | Residents Served[1] | Av. Estimated Dry Day Volume (Qd) (Gallons/Day) | Av. Dry + Wet Day Volume (Qw = Qd * ΔQ) (Gallons/Day) | Avg. Cost/Day Due to I&I ($)[2] | Avg. Cost/Year Due to I&I ($)[2] |
| 1 | 1120 | 78,800 | 131,000 | $202 | $74,000 |
| 2 | 1050 | 73,000 | 110,000 | $144 | $53,000 |
| 3 | 910 | 64,000 | 77,000 | $50 | $18,000 |
| 4 | 1121 | 83,000 | 95,000 | $46 | $17,000 |
| 5 | 1400 | 98,000 | 113,000 | $58 | $21,000 |
| 6 | 1680 | 118,000 | 136,000 | $70 | $26,000 |
| 7 | 980 | 68,000 | 133,000 | $252 | $92,000 |
| 8 | 840 | 59,000 | 65,000 | $23 | $8,000 |

[1]Using survey data from local records and the EPA, USGS and the AWWA, one can quickly ascertain the number of homes being serviced by each subsystem, the average number of individuals per household within that subsystem, the daily water usuage per average household (the EPA, USGS and AWWA have all confirmed that average daily water usage by an individual in the United States is 70 Gal/Day) and the municipality's wastewater treatment rate per 1000 gallons. These figures are imported into the the method to determine the average estimated dry volume flow rate (Qd) for each subsystem and to preferably generate reports describing each subsystem by actual increases in volume and cost due to inflow and infiltration.

[2]Average National Wastewater Treatment Rate (2007); $3.88/1000 Gal. (NUS Consulting Group)

If only 50% of the inflow and infiltration discovered in subsystems 1 and 7 is eliminated, a municipality will realize annual savings of $83,000 (or $830,000 over a ten year period). By eliminating the same percentage of inflow and infiltration generated by all 8 subsystems, taxpayers will see a decrease in their wastewater treatment charges of $1,545,000 over the same ten year period.

TABLE 3

Report 3
Inflow and Infiltration (I&I) Contribution Analysis

| VOLUME & COST CALCULATION | | MINI-SYSTEMS A-F | | (OCT. 1-DEC. 31) | |
|---|---|---|---|---|---|
| Mini-System | Residents Served[3] | Av. Estimated Dry Day Volume (SQd) (Gallons/Day) | Av. Dry + Wet Day Volume (SQw = SQd * ΔSQ) (Gallons/Day) | Avg. Cost/Day Due to I&I ($)[4] | Avg. Cost/Year Due to I&I ($)[4] |
| A (MH 1-10) | 187 | 13,090 | 16,088 | $11.60 | $4,234 |
| B (MH 10-20) | 192 | 13,440 | 15,435 | $7.75 | $2,829 |
| C (MH 20-30) | 182 | 12,740 | 14,751 | $7.80 | $2,847 |
| D (MH 30-40) | 178 | 12,460 | 34,458 | $85.35 | $31,152 |
| E (MH 40-50) | 199 | 13,930 | 31,924 | $69.80 | $25,477 |
| F (MH 50-60) | 188 | 13,160 | 18,158 | $19.40 | $7,081 |

Further isolation of inflow and infiltration on, for example, a 10 mini-system basis is now separately conducted for each of the major subsystems (1&7) having contributed the highest percentages of extraneous flow as identified by Reports 1 & 2. Repeating the identical procedure as previously employed within each major subsystem, the monitors continuously monitor both dry and dry/wet day wastewater levels within each 10 manhole (MH) mini-system. Since the goal has been to initially eliminate 50% of the total inflow and infiltration within subsystem 1 (50% of $74,000), then according to Report 3, the volume in question is located somewhere between manhole 30 and 50 (mini-systems D&E). Prior to instituting camera surveillance equipment, the investigation can now be narrowed down even further by repeating the above process for mini-systems D&E. Subsequently, the sources of inflow and infiltration are addressed and repaired.

EXAMPLE II

TABLE 4

COMPARATIVE COST ANALYSIS SHOWING PROJECTED COSTS OF THE INVENTIVE FLOW STUDY METHOD VERSUS THE CONVENTIONAL METHOD

| Inventive Flow Study Method | | Conventional Flow Study (Doppler Portable Meters) | |
|---|---|---|---|
| Five I & I Detection Modules w/Flow Analysis Software | $13,500 | Five Portable Flow Meters w/Flow Analysis Software | $22,500 |
| Installation (5 units) | $750 | Installation (5 units) Confined Space Entry | $5,000 |
| Non-Confined Space Yearly Maintenance Contract (5 Units) | $0 | Yearly Maintenance ($800/Unit/Month) | $48,000 |
| TOTAL COST | $14,250 | TOTAL COST | $75,000 |
| TOTAL FIRST YEAR SAVINGS | | | $61,250 |
| TOTAL SAVINGS PER YEAR GOING FORWARD | | | $52,250 |

The unique ability of the inventive method for cost-effectively locating inflow and infiltration creates the potential for ultimately reducing a municipality's wastewater treatment charges by hundreds of thousands of dollars.

EXAMPLE III

TABLE 5

COST-EFFECTIVE ANALYSIS FOR REHABILITATION OF HIGHEST RANK GRID SEGMENTS

| Ranking | Segment (manhole to manhole) | Sewer Length (Ft.) | Pipe Diam. (In.) | Delta Q[5] | 50% Removable I&I (Avg. Gal/Day) | Cost Savings Per Year[6] |
|---|---|---|---|---|---|---|
| 1 | 13-15 | 1,000 | 12 | 1.82 | 20,000 | $28,324 |
| 2 | 17-20 | 1,150 | 12 | 1.54 | 14,000 | $19,826 |
| 3 | 5-7 | 1,100 | 12 | 1.12 | 8,000 | $11,329 |
| 4 | 28-30 | 950 | 10 | 1.07 | 5,100 | $7,420 |
| POTENTIAL TOTAL COST SAVINGS OVER 10 YEARS (10 × $66,900) $669,000 | | | | | | |

[5]Delta Q represents the average change in wastewater volume due to the effects of inflow and infiltration.
[6]Cost Savings Per year is based upon a wastewater treatment rate of $3.88/1000 Gallons.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A method of reducing rainwater or ground water inflow or infiltration into a wastewater collection grid comprising the steps of (a) identifying a wastewater collection grid having a configuration comprising a plurality of manholes;

(b) dividing said wastewater collection grid into a plurality of major subsystems, said configuration of said wastewater collection grid being such that each of said major subsystems has one of said manholes at an outlet end thereof;

(c) installing flow depth level detectors in said manholes at said outlets ends of said major subsystems;

(d) using said flow depth level detectors to determine for each of said major subsystems a ratio (ΔQ) of wet weather volume flow rate to dry weather volume flow rate by:

(i) measuring for each of said major subsystems using said flow depth level detectors a dry weather flow depth level (Dd) for flow during dry weather conditions;

(ii) measuring for each of said major subsystems using said flow depth level detectors a wet weather flow depth level (Dw) for flow during wet weather conditions or during a combination of wet weather and dry weather conditions;

(iii) using said dry weather flow depth levels (Dd) measured by said flow depth level detectors to determine for each of said major subsystems a dry weather cross-sectional area of flow (Ad);

(iv) using said wet weather flow depth levels (Dw) measured by said flow depth level detectors to determine for each of said major subsystems a wet weather cross-sectional area of flow (Aw); and then (v) determining for each of said major subsystems said ratio (ΔQ) of wet weather volume flow rate to dry weather volume flow rate according to a formula $$\Delta Q = \frac{Aw}{Ad} * \left(\frac{Rw}{Rd}\right)^{2/3}$$

wherein Rw is a wet weather hydraulic flow radius based upon said Aw and Rd is a dry weather hydraulic flow radius based upon said Ad;

(e) using said ΔQ ratios for said major subsystems to at least identify a highest ranking one of said major subsystems which ranks highest in contributing to said wastewater collection grid a greater volume amount or a greater cost amount of said rainwater or ground water; and (f) locating for repair or improvement one or more points of ground water or rainwater flow or infiltration in said highest ranking one of said major subsystems.

2. The method of claim 1 wherein step (f) comprises:

(A) dividing said highest ranking one of said major subsystems identified in step (e) into a plurality of smaller subsystems, said configuration of said wastewater collection grid being such that each of said smaller subsystems has one of said manholes at an outlet end thereof;

(B) installing flow depth level detectors in said manholes at said outlets end of said smaller subsystems;

(C) using said flow depth level detectors installed in step (B) to determine for each of said smaller subsystems a ratio (ΔSQ) of wet weather volume flow rate to dry weather volume flow rate by:

(1) measuring for each of said smaller subsystems using said flow depth level detectors installed in step (B) a dry weather flow depth level (SDd) for flow during dry weather conditions;

(2) measuring for each of said smaller subsystems using said flow depth level detectors installed in step (B) a wet weather flow depth level (SDw) for flow during wet weather conditions or during a combination of wet weather and dry weather conditions;

(3) using said dry weather flow depth levels (SDd) measured by said flow depth level detectors installed in step (B) to determine for each of said smaller subsystems a dry weather cross-sectional area of flow (SAd);

(4) using said wet weather flow depth level (SDw) measured by said flow depth level detectors installed in step (B) to determine for each of said smaller subsystems a wet weather cross-sectional area of flow (SAw); and then (5) determining for each of said smaller subsystems said ratio (ΔSQ) of wet weather volume flow rate to dry weather volume flow rate according to a formula $$\Delta SQ = \frac{SAw}{SAd} * \left(\frac{SRw}{SRd}\right)^{2/3}$$

wherein SRw is a wet weather hydraulic flow radius based upon said SAw, and SRd is a dry weather hydraulic flow radius based upon said SAd;

(D) using said ΔSQ ratios for said smaller subsystems to at least identify a highest ranking one of said smaller subsystems which ranks highest in contributing to said highest ranking one of said major subsystems a greater volume amount or greater cost amount of said rain water or ground water; and (E) locating for repair or improvement one or more points of ground water or rainwater flow or infiltration in said highest ranking one of said smaller subsystems.

3. The method of claim 2 wherein step (E) comprises conducting camera surveillance within said highest ranking one of said smaller subsystems to locate said points of inflow or infiltration of said rainwater or ground water in said highest ranking one of said smaller subsystems.

4. The method of claim 2 wherein, in step (D) said ΔSQ ratios are used to identify a subset of said smaller subsystems which rank highest in contributing to said highest ranking one of said major subsystems a greater volume amount or cost amount of said rainwater or ground water and which together account for from about 50% to about 80% of a total volume amount or cost amount of said rainwater or ground water received by all of said smaller subsystems.

5. The method of claim 2 wherein said method further comprises the steps of removing at least some of said flow depth level detectors installed in steps (c) in said manholes at said outlet ends of said major subsystems and re-installing in step (B) at least some of said flow depth level detectors removed in said step of removing in said manholes at said outlet ends of said smaller subsystems.

6. The method of claim 1 wherein step (e) further comprises the steps of:

(1) determining from survey data an estimated number of residents served by each of said major subsystems;

(2) determining for each of said major subsystems an estimated dry weather wastewater volume flow rate (Qd) based upon said estimated number of residents served by said major subsystem; and (3) determining for each of said major subsystems a wet weather volume flow rate (Qw) by multiplying said estimated dry weather wastewater volume flow rate (Qd) for said major subsystem by said ΔQ ratio for said major subsystem.

7. The method of claim 6 wherein step (e) further comprises the step of determining for each of said major subsystems a volume amount of rainwater or ground water contributed by said major subsystem to said wastewater collection grid by subtracting said estimated dry weather wastewater volume flow rate (Qd) for said major subsystem from said wet weather volume flow rate (Qw) for said major subsystem.

8. The method of claim 1 further comprising the step of repairing or improving at least one of said points of ground water or rainwater flow or infiltration.

9. A method of reducing rainwater or ground water inflow or infiltration into a wastewater collection grid comprising the steps of:

(a) identifying a wastewater collection grid having a configuration comprising a plurality of manholes;

(b) dividing said wastewater collection grid into a plurality of major subsystems, said configuration of said wastewater collection grid being such that each of said major subsystems has one of said manholes at an outlet end thereof;

(c) installing flow depth level detectors in said manholes at said outlet ends of said major subsystems;

(d) using said flow depth level detectors to determine for each of said major subsystems a ratio (ΔQ) of wet weather volume flow rate to dry weather volume flow rate by:

(i) measuring for each of said major subsystems using said flow depth level detectors a dry weather flow depth level (Dd) for flow during dry weather conditions;

(ii) measuring for each of said major subsystems using said flow depth level detectors a wet weather flow depth level (Dw) for flow during wet weather conditions or during a combination of wet weather and dry weather conditions;

(iii) using said dry weather flow depth levels (Dd) measured by said flow depth level detectors to determine for each of said major subsystems a dry weather cross-sectional area of flow (Ad);

(iv) using said wet weather flow depth levels (Dw) measured by said flow depth level detectors to determine for each of said major subsystems a wet weather cross-sectional area of flow (Aw);

(v) determining for each of said major subsystems said ratio (ΔQ) of wet weather volume flow rate to dry weather volume flow rate according to a formula $$\Delta Q = \frac{Aw}{Ad} * \left(\frac{Rw}{Rd}\right)^{2/3}$$

wherein Rw is a wet weather hydraulic flow radius based upon said Aw, and Rd is a dry weather hydraulic flow radius based upon said Ad;

(e) using said ΔQ ratios for said major subsystems to identify a subset of said major subsystems which rank highest in contributing to said wastewater collection grid greater volume amounts or cost amounts of said rainwater or ground water and which together account for from about 50% to about 80% of a total volume amount or cost amount of said rainwater or ground water received by said wastewater collection grid; and (f) locating for repair or improvement one or more points of ground water or rainwater flow or infiltration in said subset of said major subsystems.

10. The method of claim 9 further comprising the steps of:

(h) dividing each of said major subsystems in said subset of said major subsystems into a plurality of smaller subsystems, said configuration of said wastewater collection grid being such that each of said smaller subsystems has one of said manholes of an outlet end thereof;

(h) installing flow depth level detectors in said manholes at said outlet ends of said smaller subsystems;

(i) using said flow depth level detectors installed in step (h) to determine for each of said smaller subsystems a ratio (ΔSQ) of wet weather volume flow rate to dry weather volume flow rate by (1) measuring for each of said smaller subsystems using said flow depth level detectors installed in step (h) a dry weather flow depth level (SDd) for flow during dry weather conditions;

(2) measuring for each of said smaller subsystems using said flow depth level detectors installed in step (h) a wet weather flow depth level (SDw) for flow during wet weather conditions or during a combination of wet weather and dry weather conditions;

(3) using said dry weather flow depth levels (SDd) measured by said flow level depth detectors installed in step (h) to determine for each of said smaller subsystems a dry weather cross-sectional area of flow (SAd);

(4) using said wet weather flow depth levels (SDw) measured by said flow depth level detectors installed in step (h) to determine for each of said smaller subsystems a wet weather cross-sectional area of flow (SAw); and then (5) determining for each of said smaller subsystems said ratio (ΔSQ) of wet weather volume flow rate to dry weather volume flow rate according to a formula $$\Delta SQ = \frac{SAw}{SAd} * \left(\frac{SRw}{SRd}\right)^{2/3}$$

wherein SRw is a wet weather hydraulic flow radius based upon said SAw, and SRd is a dry weather hydraulic flow radius based upon said SAd;

(j) for each of said major subsystems in said subset of said major subsystems, using said ΔSQ ratios for said smaller subsystems to at least identify a highest ranking one of said smaller subsystems which ranks highest in contributing to said major subsystem a greater volume amount or cost amount of said rainwater or ground water; and (k) locating for repair or improvement one or more points of ground water or rainwater flow or infiltration in each said highest ranking one of said smaller subsystems.

11. The method of claim 10 wherein, for each of said major subsystems in said subset of said major subsystems, step (k) comprises conducting camera surveillance within said highest ranking one of said smaller subsystems to locate said points of inflow or infiltration of said rainwater or ground water.

12. The method of claim 10 wherein, for each of said major subsystems in said subset of said major subsystems, said ΔSQ ratios are used in step (j) to identify a subset of said smaller subsystems in said major subsystem which rank highest in contributing to said major subsystem greater volume amounts or cost amounts of said rainwater or ground water and which together account for from about 50% to about 80% of a total volume amount or cost amount of said rainwater or ground water received by all of said smaller subsystems in said major subsystem.

13. The method of claim 10 wherein said method further comprises the steps of removing at least some of said flow depth level detectors installed in step (c) in said manholes at said outlet ends of said major subsystems and re-installing in step (h) in said manholes at said outlet ends of said smaller subsystems at least some of said flow depth level detectors removed in said step of removing.

14. The method of claim 10 wherein step (e) further comprises the steps of:

(1) determining from survey data an estimated number of residents served by each of said major subsystems;

(2) determining for each of said major subsystems an estimated dry weather wastewater volume flow rate (Qd) based upon said estimated number of residents served by said major subsystem; and (3) determining for each of said major subsystems a wet weather volume flow rate (Qw) by multiplying said estimated dry weather wastewater volume flow rate (Qd) for said major subsystem by said ΔQ ratio for said major subsystem.

15. The method of claim 14 wherein step (e) further comprises the step of determining for each of said major subsystems a volume amount of rainwater or ground water contributed by said major subsystem to said wastewater collection grid by subtracting said estimated dry weather wastewater volume flow rate (Qd) for said major subsystem from said wet weather volume flow rate (Qw) for said major subsystem.

16. The method of claim 14 wherein step (j) further comprises the steps of:

(1) determining from survey data an estimated number of residents served by each of said smaller subsystems;

(2) determining for each of said smaller subsystems an estimated dry weather waste water volume flow rate (SQd) based upon said estimated number of residents served by said smaller subsystem; and (3) determining for each of said smaller subsystems a wet weather volume flow rate (SQw) by multiplying said estimated dry weather wastewater volume flow rate (SQd) for said smaller subsystem by said ΔSQ ratio for said smaller subsystem.

17. The method of claim 16 wherein step (j) further comprises the step of determining for each of said smaller subsystems a volume amount of rainwater or ground water contributed by said smaller subsystem to said wastewater collection grid by subtracting said estimated dry weather wastewater volume flow rate (SQd) for said smaller subsystem from said wet weather volume flow rate (SQw) for said smaller subsystem.

18. The method of claim 9 further comprising the step of repairing or improving at least one of said points of ground water or rainwater flow or infiltration.

* * * * *

UNITED STATES PATENT AND TRADEMARK OFFICE

CERTIFICATE OF CORRECTION

PATENT NO. : 8,447,533 B1
APPLICATION NO. : 12/902218
DATED : May 21, 2013
INVENTOR(S) : Sinclair et al.

It is certified that error appears in the above-identified patent and that said Letters Patent is hereby corrected as shown below:

In the Claims:

Column 13, Claim 10, Line 20: (h) is corrected to read (g)

Signed and Sealed this
Sixteenth Day of July, 2013

Teresa Stanek Rea
*Acting Director of the United States Patent and Trademark Office*